United States Patent [19]

Schittenhelm et al.

[11] Patent Number: 4,659,586

[45] Date of Patent: Apr. 21, 1987

[54] PROCESS FOR ELECTROSTATICALLY SPRAYING INORGANIC POWDERS

[75] Inventors: Hans-Joachim Schittenhelm, Leverkusen; Werner Joseph, Cologne, both of Fed. Rep. of Germany

[73] Assignee: Bayer Aktiengesellschaft, Leverkusen, Fed. Rep. of Germany

[21] Appl. No.: 787,834

[22] Filed: Oct. 16, 1985

[30] Foreign Application Priority Data

Oct. 25, 1984 [DE] Fed. Rep. of Germany ..... 3439007

[51] Int. Cl.[4] ..... B05D 1/06

[52] U.S. Cl. ..... 427/27; 427/427; 106/308 B

[58] Field of Search ..... 427/27, 427; 106/308 B

[56] References Cited

U.S. PATENT DOCUMENTS 3,443,973 5/1969 Bugosh ..... 106/308 B 3,928,668 12/1975 Snow ..... 427/27

*Primary Examiner*—Richard Bueker

*Attorney, Agent, or Firm*—Sprung Horn Kramer & Woods

[57] ABSTRACT

In the electrostatic spraying on metal substrates of mixtures of different inorganic powders which differ in density, particle size and electrical resistance, the improvement which comprises first forming uniform agglomerates as the different powders, and then spraying the uniform agglomerates. This prevents color variation due to separation of different powders.

3 Claims, No Drawings

PROCESS FOR ELECTROSTATICALLY SPRAYING INORGANIC POWDERS

The present invention relates to the electrostatic application of powder mixtures of physically different systems, particularly the electrostatic powder application of enamel powder and mixtures of color oxides.

It is known from German Pat. No. 2 015 072, to produce enamel powder with high electrical resistance for electrostatic powder application, while electrically insulating materials are added to the enamel frit; which react with the SiOH groups on the surface of the frit. In this manner, substantially homogeneous enamel powders with high surface resistance can be obtained and applied electrostatically onto metallic substrates and good adhesion can be achieved.

During the electrostatic powder application of enamel for color-enamelling; which consists of a mixture of enamel frits and color oxides, separation takes place owing to the generally varying density, particle size and resistance of enamel powders and color oxides during the electrostatic powder application; which separation has so far been an obstacle to wider use of the electric powder application of frit/color oxides systems in color enamelling. As a result of this separation, it is no longer possible, particularly in the case of pastel tones, to achieve constant uniform color tones by the electrostatic application of powders.

While enamel powders for application in an electric field normally have an average particle size of from 10 to 60 μm and a density of about 2,4 g/cm$^3$, the corresponding values for color oxides are, for example, from 1 to 5 μm and from 4 to 6 g/cm$^3$. If these are now electrostatically sprayed together by means of transporting air, separation occurs when passing from the electrostatic spraying device to the work piece to be coated, owing to gravity (density), aerodynamic influences (particle size), as well as the electric field (resistance), which separation leads to uneven, fluctuating color tones on the enamelled substrate. These differences in color are intensified during continuous application by recirculating the powder as well as by addition of fresh powder.

It has now been found that such mixing systems are electrostatically sprayable, without the disadvantageous separation, if substantially uniform agglomerates are formed before the electrostatic application of powder particles with physically different properties; for example, enamel frit particles and color oxides particles, and these agglomerates are then sprayed.

Thus an object of the present invention is a process for electrostatically spraying mixtures of different inorganic powders with a high surface resistance, particularly enamel powders and color oxides, on metallic substrates, characterized in that substantially uniform agglomerates are formed before the electrostatic spraying, of powder particles differing in density, particle size and electrical resistance, and these uniform agglomerates are then sprayed.

The agglomerates are produced according to the invention in that the powders differing in particle size and density are mixed with an agglomeration-promoting adhesive or are crushed together. The concentration of the adhesive is selected such that relatively big particle coagulation is prevented, while relatively small particles remain adhered to relatively large particles. In the ideal case, agglomerates are thereby obtained, which each consist of a relatively large enamel powder particle with relatively small color oxides particles adhering thereon.

It is important in electrostatic powder application that the addition of the agglomerating agent does not simultaneously lead to a deterioration in the properties of the powder, such as a decrease in the electrical powder resistance of a reduction in the fluidity of the powder mixture. During operation of the present invention, it is useful to crush the enamel frit and the color oxides powder, according to German Pat. No. 2 015 072, for example, together with silicon-organic compounds, such that they have an electrical resistance which is suitable for electrostatic powder application. The agglomeration-promoting substances can thus be added before, during or after the crushing process. In the latter case, the mixture is subjected to a crushing movement for a short time, for better distribution and formation of suitable agglomerates. The enamel frit and the color oxides are crushed according to the required degree of crushing in crushing device, for example, in ball mills, with addition of silicon-organic compounds and agglomerating agents.

The Si-organic compounds are added in a quantity of from 0.1 to 1.0% by weight, based on the frit proportion, preferably from 0.2 to 0.4% by weight, the agglomerating agents are added in a quantity of from about 0.1 to 0.5% by weight.

Organopolysiloxanes, organosilazanes, organosiloxanoles can be used as Si-organic compounds. Methylhydrogen-siloxanes, dimethyl-siloxane, hexamethyldisilazane, methyl-vinyl-siloxane are preferred.

Screen printing oils, for example, pine oil or unsaturated fatty acids such as linseed oil or caster oil are particularly suitable as agglomerating agents. Furthermore, polyphenols such as tannin can be used for the purpose according to the invention.

The formation of agglomerates consisting of frit particles and color oxides can be easily detected in that after sieving the crushed powder in a sieve with a mesh width of 40 μm, a homogeneous colored residue remains, which consists of colorless frit particles, onto which color oxides is added. Should the agglomerate formation according to the invention not take place, frit particles are separated by the described sieve test from the finely-dispersd color oxides particles, the coarser colorless frit particles remaining on the sieve.

The coloring powder agglomerates obtained in this manner are distinguished by high electrical resistance and good fluidity. During spraying on metallic substrates of the powder produced in this manner, no separation of the frit particles and color oxides particle takes place. According to enamel technology, this can be detected in that an electrostatically powder coated steel has the same coloring (color location and brightness) after firing as a sample coated in the same manner with recuperated powder.

The object of the present invention should now be explained in more detail by means of the following examples (% data are in each case % by weight).

EXAMPLE 1

950 g of commercial transparent frit in form of flakes, 50 g of rutile color oxide, 3.5 kg of high density balls with an average diameter of from 20 to 30 mm, 4 g of methyl-H-siloxane with a viscosity of 15 mPa.sec, as well as 2 g of tannin are added to a 1 kg porcelain ball crusher. The crusher is then sealed and the crushing bulk is crushed until the residue on the 40 μm sieve is less than 20%. The powder mixture obtained in this manner has an electrical resistance of more than $10^{12}$ Q after a storage time of 24 h in air at room temperature of 23° C. and a relative air humidity at 50%.

The powder mixture obtained in this manner is sprayed with a commercial electrostatic pistol by applying a voltage of 80 KV to the corona electrodes in a 10×10 cm steel sheet which has been degreased and pickled. After applying from 4 to 5 g of powder/$dm^2$, the electrostatically powder coated sample plate is fired for 3.5 min at 820° C. and then measured for its color content.

The powder mixture which has not precipitated on the plate is collected and sprayed under the same conditions onto a second steel sheet of the same size and again fired. The color-content measurement of this recuperated powder does not differ from the first application. This clearly shows that agglomerates are formed by the process according to the invention and no color-variation separation of the frit and the color oxides particles takes place.

EXAMPLE 2

As described in Example 1, again 950 g of commercial transparent enamel frit, 50 g of rutile color oxides, 4 g of siloxane according to Example 1, as well as 1 g of castor oil are added to the same ball crusher and crushed until the maximum particle distribution of the powder mixture is below 40 μm and less than 20% of the residue remains on the sieve The electrical resistance of the powder mixture is $8.10^{11}$ Q after storing for 24 h at room temperature with a relative air humidity of 50%. The frit color oxides powder mixture is enamel-technology tested, as described in Example 1, by spraying and firing. The test plates coated with fresh powder and recuperated powder show no difference in color.

The formation of uniform agglomerates from coloring matter and frit particles can be demonstrated in a simple manner in that the powder mixture is sieved in a 40 μm sieve. The sieve residue is colored and frit/coloring matter-agglomerates can be observed under a microscope. Without addition of castor oil, the fine coloring matter is separated during sieving from the transparent frit powder, colorless frit particles remain as seive residue.

It will be understood that the specification and examples are illustrative but not limitative of the present invention and that other embodiments, within the spirit and scope of the invention will suggest themselves to those skilled in the art.

What is claimed is:

1. A process for the electrostatic spraying on metal substrates of mixtures of different inorganic powders which differ in density, particle size and electrical resistance, comprising first forming uniform agglomerates as the different powders, and then spraying the uniform agglomerates, wherein the inorganic powders contain Si—OH groups, the inorganic powders comprise a mixture of enamel frit and coloring matter, and a silicon-organic compound which reacts with the Si—OH groups of the mixture and an organic hydroxyl group-containing compound are added to the mixture before or during crushing to form the agglomerates.

2. A process according to claim 1, wherein the silicon-organic compound is a methyl-H-polysiloxane, and the hydroxyl group-containing organic compound is at least one of pine oil and castor oil.

3. A process according to claim 1, wherein the silicon-organic compound is a methyl-H-siloxane, and the hydroxyl group-containing organic compound is tannin.

* * * * *